US007770523B2

(12) United States Patent
Kovac

(10) Patent No.: US 7,770,523 B2
(45) Date of Patent: Aug. 10, 2010

(54) INTERACTIVE AMUSEMENT PARK ATTRACTION VEHICLE

(75) Inventor: Michael G. Kovac, Temple Terrace, FL (US)

(73) Assignee: University of South Florida, Tampa, FL (US)

( * ) Notice: Subject to any disclaimer, the term of this patent is extended or adjusted under 35 U.S.C. 154(b) by 229 days.

(21) Appl. No.: 11/539,680

(22) Filed: Oct. 9, 2006

(65) Prior Publication Data

US 2007/0089633 A1 Apr. 26, 2007

Related U.S. Application Data

(60) Provisional application No. 60/725,030, filed on Oct. 7, 2005.

(51) Int. Cl.
*A63G 1/00* (2006.01)

(52) U.S. Cl. ..... 104/86

(58) Field of Classification Search ..... 104/53, 104/57, 59, 63, 68, 82, 86
See application file for complete search history.

(56) References Cited

U.S. PATENT DOCUMENTS

| | | | | |
|---|---|---|---|---|
| 3,066,951 | A | 12/1962 | Gray | |
| 4,272,093 | A | 6/1981 | Filice et al. | |
| 4,487,410 | A * | 12/1984 | Sassak | 472/131 |
| 4,501,434 | A * | 2/1985 | Dupuis | 280/206 |
| 4,545,574 | A | 10/1985 | Sassak | |
| 5,453,053 | A | 9/1995 | Danta et al. | |
| 5,791,254 | A | 8/1998 | Mares et al. | |
| 6,060,847 | A | 5/2000 | Hettema | |
| 7,030,894 | B2 | 4/2006 | Allen et al. | |

FOREIGN PATENT DOCUMENTS

WO 2006021572 A1 3/2006

* cited by examiner

*Primary Examiner*—S. Joseph Morano
*Assistant Examiner*—Robert J McCarry, Jr.
(74) *Attorney, Agent, or Firm*—Ronald E. Smith; Smith & Hopen P.A.

(57) ABSTRACT

An apparatus capable of transporting a rider, specifically for an amusement ride. The apparatus is constructed in the form of a substantially hollow sphere which rides along the ground, which is preferably inclined, a track, or a predetermined path (being substantially flat but with guide rails or walls along its sides). An inner carriage, to which the rider's seat is attached, moves independently of the sphere and maintains a substantially constant attitude while the sphere rolls. The inner carriage can be formed in varying shapes such as a sphere, hemisphere, semicircle, tube or a circle.

13 Claims, 6 Drawing Sheets

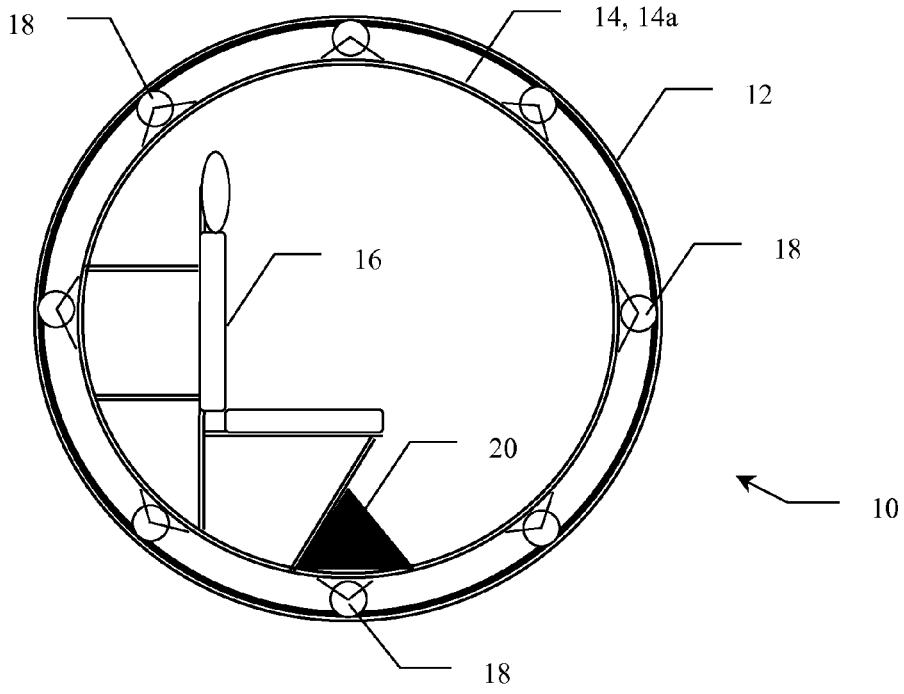
FIG. 1A
FIG. 1B
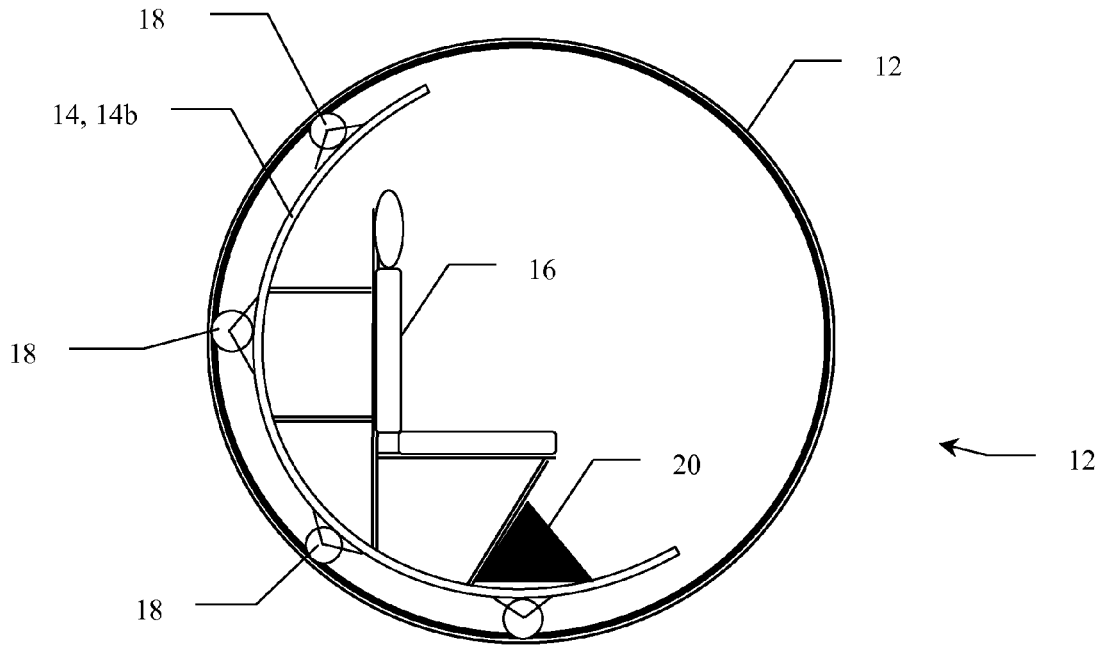

INTERACTIVE AMUSEMENT PARK ATTRACTION VEHICLE

CROSS REFERENCE TO RELATED APPLICATIONS

This application claims priority to currently U.S. Provisional Patent Application No. 60/725,030, filed Oct. 7, 2005.

BACKGROUND OF THE INVENTION

The roller coaster is a popular amusement ride developed for amusement parks and modern theme parks. Most roller coasters are made up of a track that rises and falls in intricate patterns; sometimes with one or more inversions (the most common being loops) that turn the rider briefly upside down. The track does not necessarily have to be a complete circuit (i.e. a "shuttle"). Most coasters have cars for two, four, or six passengers each, in which the passengers sit to travel around the track. Multiple cars are usually hooked together to form a train.

The train design offers riders sitting in the front car a very different experience from those sitting in the rear car. While the riders in the rear car do not get an unobstructed view, the riders in the front car must wait for the rear car to clear the top of the hill before beginning the acceleration which makes the ride enjoyable; particularly on the first drop, or lift hill which is described below.

The cars on a typical roller coaster are not self-powered. Instead, a standard full-circuit lift-powered coaster is pulled up with a chain or cable along the lift hill to the first peak of the coaster track. Then potential energy becomes kinetic energy as the cars race down the first downward slope. Kinetic energy is converted back into potential energy as the train moves up again to the second peak. This is necessarily lower as some mechanical energy is lost due to friction.

Alternatively, the train may be set into motion by a launch mechanism (flywheel launch, linear induction motors, linear synchronous motors, hydraulic launch, compressed air launch, drive tire, etc.). Some coasters move back and forth along the same section of track; these roller coasters are called shuttles because of this motion and usually run the circuit once with riders moving forwards and then backwards through the same course. Some roller coasters are powered by a kind of locomotive. A brake run at the end of the circuit is the most common method of bringing the roller coaster ride to a stop.

To date, there have been two main types of roller coasters: steel roller coasters and wooden roller coasters. Steel coasters are known for their smooth ride and often convoluted shapes with frequent inversions. Wooden coasters are fondly looked at by coaster enthusiasts for their rough ride and the air-time produced by negative G-forces when the coaster car reaches the top of some hills along the ride.

Coasters come in a multitude of designs. Some designs take their cue from how the rider is positioned to experience the ride. Traditionally, coaster riders sit facing forward in the coaster car, while newer coaster designs have ignored this tradition in the quest for building more exciting, unique ride experiences for the riders. Some coasters seat the passenger in a body-less frame, with the passenger's legs dangling in the air and providing a less obstructed view of the ground, thus providing an extra scare to the passengers. Another variation involves cars that have the riders in a standing position (though still heavily strapped in). Finally, some roller coasters spend some or all of their travel time with the passengers sitting in the opposite direction to their travel, so they cannot see what direction the coaster will travel next. In addition to changing the rider's viewpoint, coaster designs also focus on track styles to make the ride fresh and different from other coasters.

Traditional coasters, however fresh and different from other coasters, do not provide riders with a unique experience from ride to ride. Each coaster is usually confined by the rigidity of the track and the cars. Therefore, what is needed is an amusement attraction which improves on the prior art by providing an experience that is interactive, varies from ride to ride, not hindered by its connection to other "cars" while still providing the speed and thrills, vis-à-vis inversion, sought after by riders.

SUMMARY OF INVENTION

In a first embodiment, the invention provides an apparatus capable of transporting a rider, specifically for an amusement ride. The apparatus is constructed in the form of a substantially hollow sphere which rides along the ground, which is preferably inclined, a track, or a predetermined path (being substantially flat but with guide rails or walls along its sides). An inner carriage, to which the rider's seat is attached, moves independently of the sphere and maintains a substantially constant attitude while sphere rolls. The inner carriage can be formed in varying shapes such as a sphere, hemisphere, semicircle, circle or a tubular skeletal frame. More particularly, the novel vehicle includes a spherical outer shell having a first diameter, a spherical or hemispherical inner shell having a second diameter less than the first diameter, a plurality of spherical rollers, each of which has a diameter substantially equal to one-half the difference between the first diameter and the second diameter. The inner shell is positioned within a hollow interior of the spherical outer shell and shares a common center therewith so that the inner shell is concentrically disposed relative to the spherical outer shell. The rollers of the plurality of spherical rollers are disposed in spaced apart relation to one another in a space that separates the spherical outer shell from the inner shell so that the outer and inner shells may rotate about the common center independently of one another. At least one passenger seat is disposed within the inner shell. In a first embodiment, a passenger steers the vehicle by shifting his or her weight while supported by the passenger seat. In a second embodiment, the passenger seat is mounted for lateral displacement and the passenger steers the vehicle by manually causing the passenger seat to displace in a preselected lateral direction. In a third embodiment, a hollow casing is fixedly secured to the inner shell and a weight is slideably mounted within the hollow casing. A handle is adapted to be engaged by a passenger seated in the passenger seat; the handle is engaged to the weight so that movement of the handle effects movement of the weight. Accordingly, when the spherical outer shell is rolling on a surface, a passenger seated in the passenger seat may control the direction of rolling by manipulating the handle. The handle is pivotally secured to the casing at a first pivot point that is between a proximal and a distal end of the handle and the handle is pivotally secured to the weight at a second pivot point at a distal end of the handle. The passenger manipulates a proximal end of the handle and causes the handle to pivot about the first pivot point, thereby causing sliding displacement of the weight in the hollow casing and thereby enabling the passenger to steer the vehicle. In a fourth embodiment, the vehicle is adapted to follow a path of travel defined by a plurality of downwardly inclined guide rails that capture the spherical outer shell and allow it to roll along a path of travel defined by the guide rails. The guide rails may be arrayed in a triangular or square configuration to capture the spherical outer shell.

In another embodiment the sphere is constructed from two matching hemispheres. The sphere can be opaque, having a view screen inside to project images to the rider(s), substantially transparent, louvered, or perforated to allow vision there through. In a more specific embodiment the sphere is louvered or perforated such that its rotation creates the illusion, to the rider(s), that the sphere is invisible. The sphere can be equipped with shock absorbent pads placed on its surface to prevent direct contact with the ground or track to prevent damage, or scratching.

In another embodiment, a plurality of rollers disposed on the side of the inner carriage opposite the seat maintain contact with the inner surface of the sphere, this helps the carriage maintain the proper attitude as the sphere rolls. The rollers are any device, or configuration, that allows the inner carriage to substantially maintain the proper attitude and illustrative devices include wheels, ball bearings and casters. A control mechanism can vary, i.e. brake, the rotation of the rollers; thereby creating friction on the inner surface of the hollow sphere and changing the path of the sphere.

In another embodiment, the invention includes a drive mechanism and at least one drive wheel that engages the inner surface of the sphere. Rotation of the drive wheel against the inner surface of the sphere causes the apparatus to roll. The drive wheel(s) may be one, or all, of the rollers. Examples of drive mechanisms include electric motors and human-powered pedal devices.

In another embodiment, the invention includes a weight mounted within the sphere with a control adapted for altering the position of the weight, most commonly laterally. The lateral movement of the weight alters the combined center of gravity of the sphere, carriage and rider(s); thereby altering the sphere's path of travel.

In yet another embodiment, the seat is adapted for lateral movement. The lateral movement of the seat alters the combined center of gravity of the sphere and changes the sphere's path of travel.

BRIEF DESCRIPTION OF THE DRAWINGS

For a fuller understanding of the invention, reference should be made to the following detailed description, taken in connection with the accompanying drawings, in which:

FIG. 1A is a cross-sectional view of one embodiment of the inventive apparatus wherein the inner carriage is in the form of a sphere.

FIG. 1B is a cross-sectional view of one embodiment of the inventive apparatus wherein the inner carriage is in the form of a hemi-sphere.

DETAILED DESCRIPTION OF THE PREFERRED EMBODIMENT

Figure 2A:
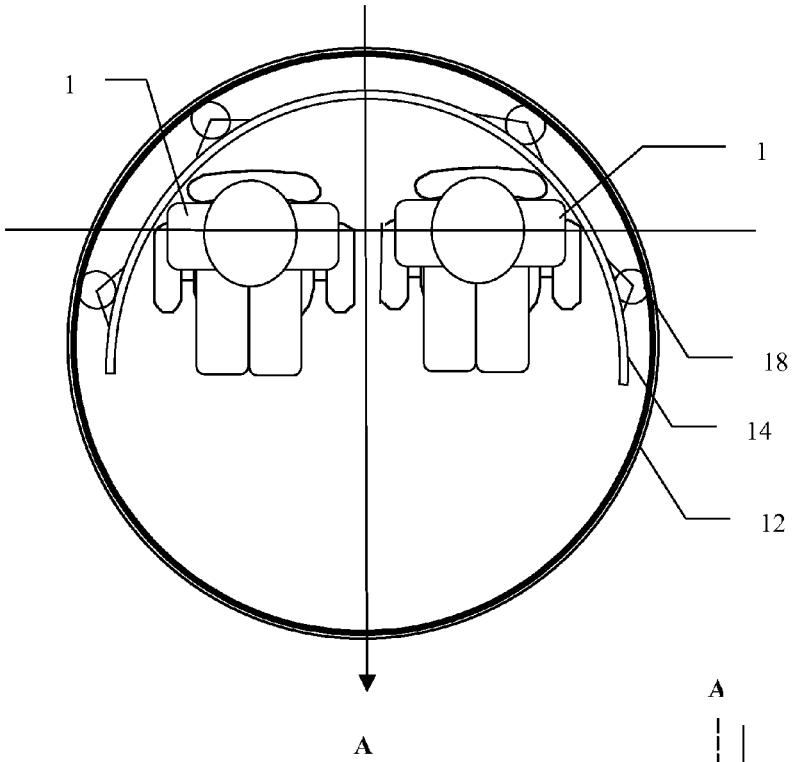
FIG. 2A is an elevated plan view of the inventive apparatus wherein two riders are in the neutral position.

In the following detailed description of the preferred embodiments, reference is made to the accompanying drawings, which form a part hereof, and within which are shown by way of illustration specific embodiments by which the invention may be practiced. It is to be understood that other embodiments may be utilized and changes may be made without departing from the scope of the invention.

FIGS. 1A and 1B show alternate embodiments of vehicle 10 of the invention. FIG. 1A shows an embodiment wherein vehicle 10 comprises substantially hollow outer-sphere 12. Sphere 12 is hollow to accommodate inner carriage 14, formed as a sphere 14*a*, and seat 16. Carriage 14 is spaced apart from the inner surface of sphere 12 by rollers 18. Rollers 18 are in contact with the inner surface of sphere 12 but are fixedly mounted to carriage 14. In this manner, carriage 14 maintains a substantially constant attitude as sphere 12 rolls. Sphere 12 can be constructed from a variety of materials, including, but not limited to: solid plastic, perforated plastic, high strength carbon composites, thin-walled perforated metal, steel, aluminum, carbon composite and heavy metallic mesh.

Outer Sphere

The sphere of one embodiment is constructed from a solid material (steel, aluminum, carbon composite) which may be opaque. The shell can then be perforated or louvered. The sphere of this embodiment has sufficient integrity to roll directly on the track or ground. Moreover, the louvered surface of sphere 12 can be adapted to effectively make the sphere seem transparent to the rider (and to an observer) once it is rolling. That is, to the eye of the rider, the sphere seems to disappear because the solid portions of the sphere move so rapidly in the rider's field of view that the eye integrates the scene beyond the sphere surface. This creates a "thrill sensation" of seeming to be riding in space with only the seating structure in the stationary field of view.

The outer surface of sphere 12 can be further equipped with a shock absorbent material, such as rubber or other composite, for contact with the ground surface. The shock absorbent material of one embodiment protrudes (about 0.25 to 1.0 inches) from the sphere and will be surface that makes contact with the track. In addition to making a better ride, the shock absorbent material eliminates scratching of the sphere, for embodiments in which the sphere is transparent, which might otherwise cause loss of visibility.

Sphere 12 can be made of a combination of two substantially hollow hemispheres separated by a tubular support structure. It also allows for customizing the weight (mass) of vehicle 10. The interior seat structure rides on the inner surface of the inner carriage and the whole vehicle rolls on the exterior surface of the outer sphere.

Methods of constructing spherical devices capable of accepting a human passenger can be incorporated into the invention. Illustrative spherical devices that can be modified for use include U.S. Pat. No. 5,791,254 to Mares et al., International Patent Publication WO 2006/021,572, U.S. Pat. No. 4,272,093 to Filice et al.; which are incorporated herein by reference.

Inner Carriage

In one embodiment, inner carriage 14 maintains a substantially constant attitude as sphere rolls 12 due to a plurality of rollers 18 disposed on the side of the inner carriage opposite seat 16. Rollers 18 are any device, or configuration, that allows inner carriage 16 to substantially maintain the proper attitude by moving independently of sphere 12 and illustrative devices include wheels, ball bearings and casters. A control mechanism can alter the rotation of the rollers (i.e. brake); thereby creating friction on the inner surface of the hollow sphere and changing the path of sphere 12.

For example, in FIGS. 1A and 1B, inner carriage 14 remains in a substantially fixed attitude relative to the ground (G) while sphere 12 rolls down the incline plane. Seat 16 is equipped with a restraint harness (not shown) similar to those found on inversion roller coasters. The term "substantially constant attitude" does not imply that carriage 14 does not have any rotation along any axis. Rather the term is relative to the substantially constant, although varied, rotation of sphere 12. Carriage 14 will experience some rotation due to the friction between sphere 12 and rollers 18, which are affixed to carriage 14. Moreover, if a user elected to prevent the movement of all rollers (18), or enters a hard brake, the isolation of movement between sphere 12 and carriage 14 will be lost causing carriage 14 to rotate at the same speed and along the same axis as sphere 12. Therefore, a "substantially constant attitude" is one that is chosen by the user and refers to the net orientation of the carriage.

FIGS. 1A and 1B show illustrative configurations for inner carriage 14. In FIG. 1A for example, carriage 14 can be constructed by a hollow sphere (14*a*) having a diameter less than sphere 12. Alternatively, FIG. 1B shows an embodiment wherein inner carriage 14 is a hemisphere (14*b*). The embodiment of FIG. 1B provides easier access to seat 16 since no opening needs to be provided other than that in sphere 12. In all embodiments, inner carriage 14 can be a solid construction or a skeletal structure making contact at limited points to the inner surface of the outer sphere.

In another embodiment, the invention includes a drive mechanism and at least one drive wheel that engages the inner surface of the sphere. Rotation of the drive wheel against the inner surface of the sphere causes the apparatus to roll. The drive wheel(s) may be one, or all, of the rollers. Examples of drive mechanisms include electric motors and human-powered pedal devices.

Steering Mechanisms

Riders have the ability to "steer" vehicle 10 as it rolls. This ability allows a truly interactive amusement ride where the rider determines the path and possibly the duration of the ride. "Steering" is accomplished by a combination of altering the center of combined mass of vehicle 10 (sphere 12 and carriage 14) and friction with the surface on which it travels.

Figure 2B:
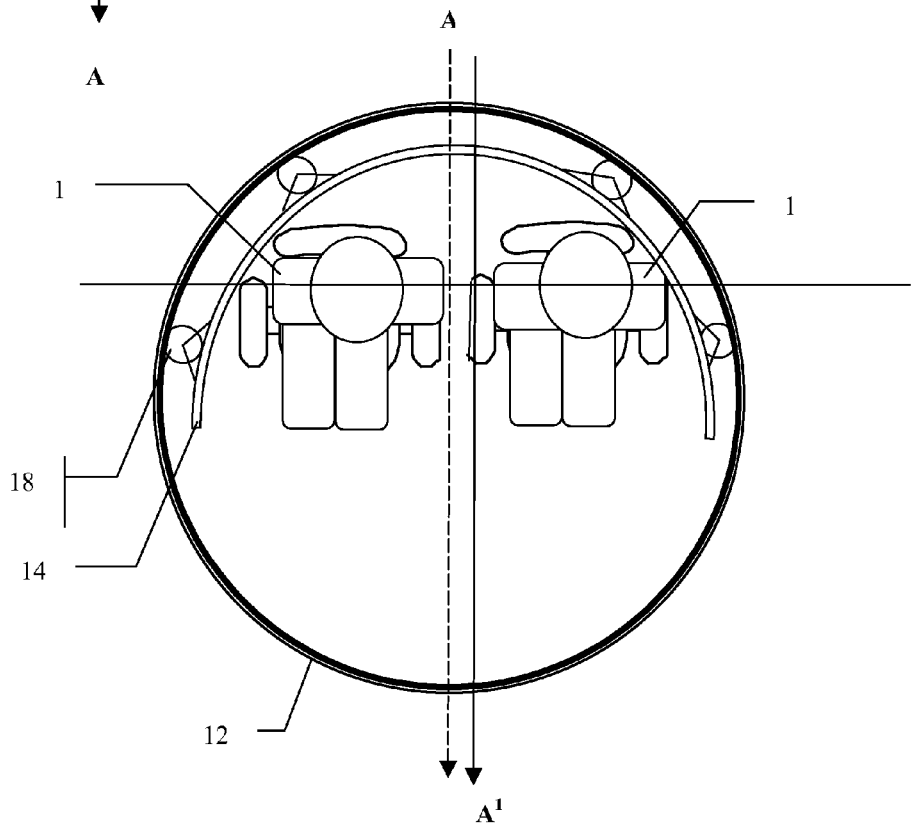
FIG. 2B is an elevated plan view of the inventive apparatus wherein two riders are in a steering position; thereby changing the center of mass of the sphere.

In one embodiment, shown in FIGS. 2A and 2B, riders 1 can "steer" by manually shifting their weight. Here, seat 16 is adapted for lateral movement. The lateral movement of the seat 16 alters the combined center of gravity (A) of the apparatus and thereby changes the sphere's path of travel. If the riders shift their weight from a centered position (A) (FIG. 2A) laterally to the rider's left (FIG. 2B) the center of mass changes ($A^1$), which combined with its forward motion will cause vehicle 10 to go to the left. (The restraining mechanism for the riders is designed to allow such movement).

This configuration can also be adapted for a cylindrical (or "log") embodiment (not shown). A massive bench (upon which the riders collectively sit) is adapted to slide left or right. The bench is on rollers or on sliding surfaces. Assuming that the upper bodies of the riders are constrained from movement using current state of the art restraints, the center of mass of the inner part of the vehicle is altered by the riders pushing with their feet to move themselves and the massive bench either left or right.

In another embodiment, riders can remain stationary in their seats and can steer by moving a simple lever mechanism that will move a heavy mass such that the direction of the vehicle is altered. Weight 20 is mounted within sphere 12, preferably attached to carriage 14 at the lowest possible point. A control is adapted for altering the position of the weight, most commonly laterally. The lateral movement of the weight alters the combined center of mass of sphere 12, carriage 14 and rider(s); thereby altering the path of travel of vehicle 10.

Figure 3A:
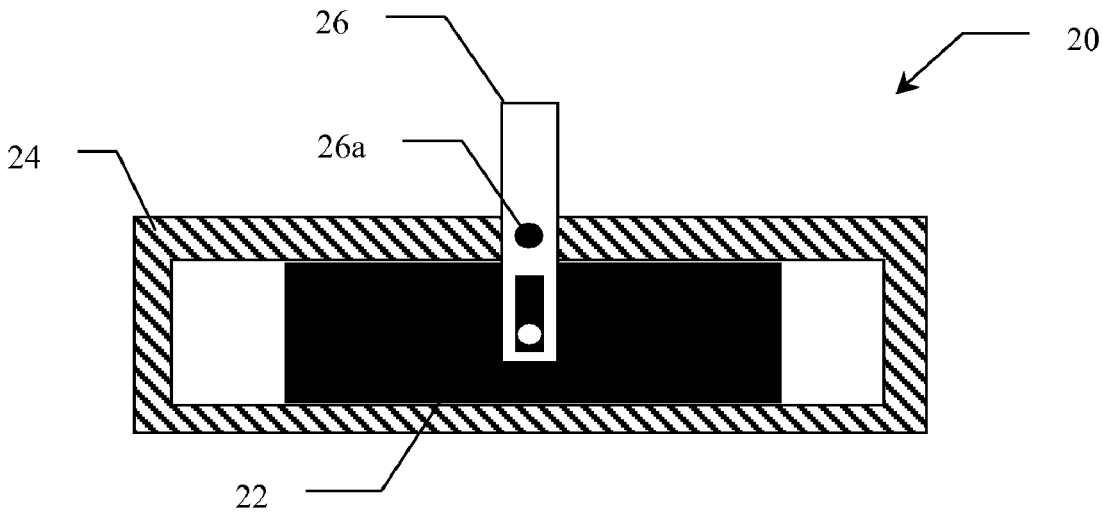
FIG. 3A is a partially cross-sectional, elevated view of one steering mechanism comprising a weighted mass disposed within the sphere; the mass as shown is in the neutral position.
Figure 3B:
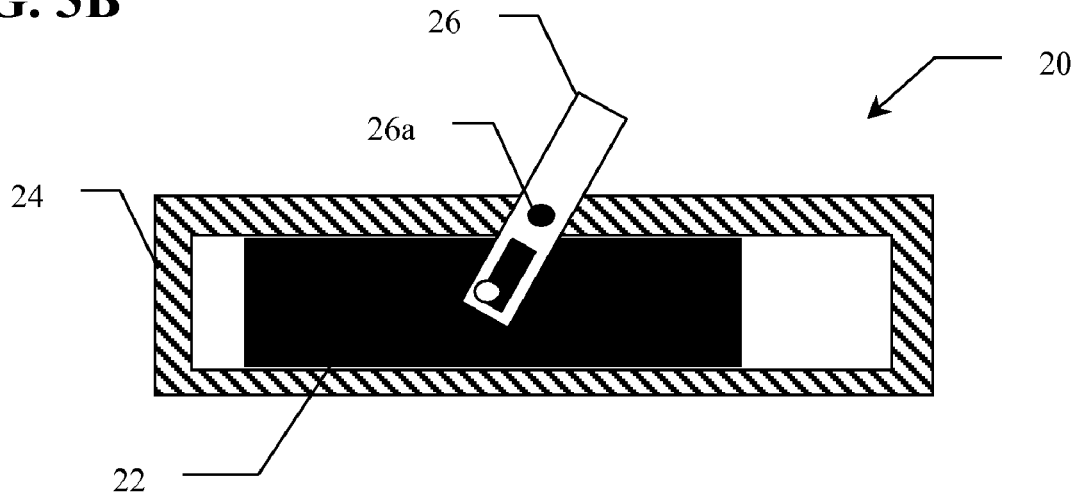
FIG. 3B is a partially cross-sectional, elevated view of one steering mechanism comprising a weighted mass disposed within the sphere; the mass as shown is in a steering position.

Referring now to FIGS. 3A and 3B, weight 22 is mounted under seat or under seat 16. Casing 24 is provided to keep the riders feet free from moving parts and injury. The inside of casing 24 is preferably constructed from or coated with a low-friction surface. Lever 26 pivots on a rod 26*a* in such a manner to cause the weight 22 to move to the left (as shown in FIG. 3B) or right. The movement of weight 22 changes the center of mass of vehicle 10 and effectively steers the vehicle. The use of weighted steering mechanism 20 can be used in isolation from, or in conjunction with, rider-effected steering of the previous embodiment.

Figure 4:
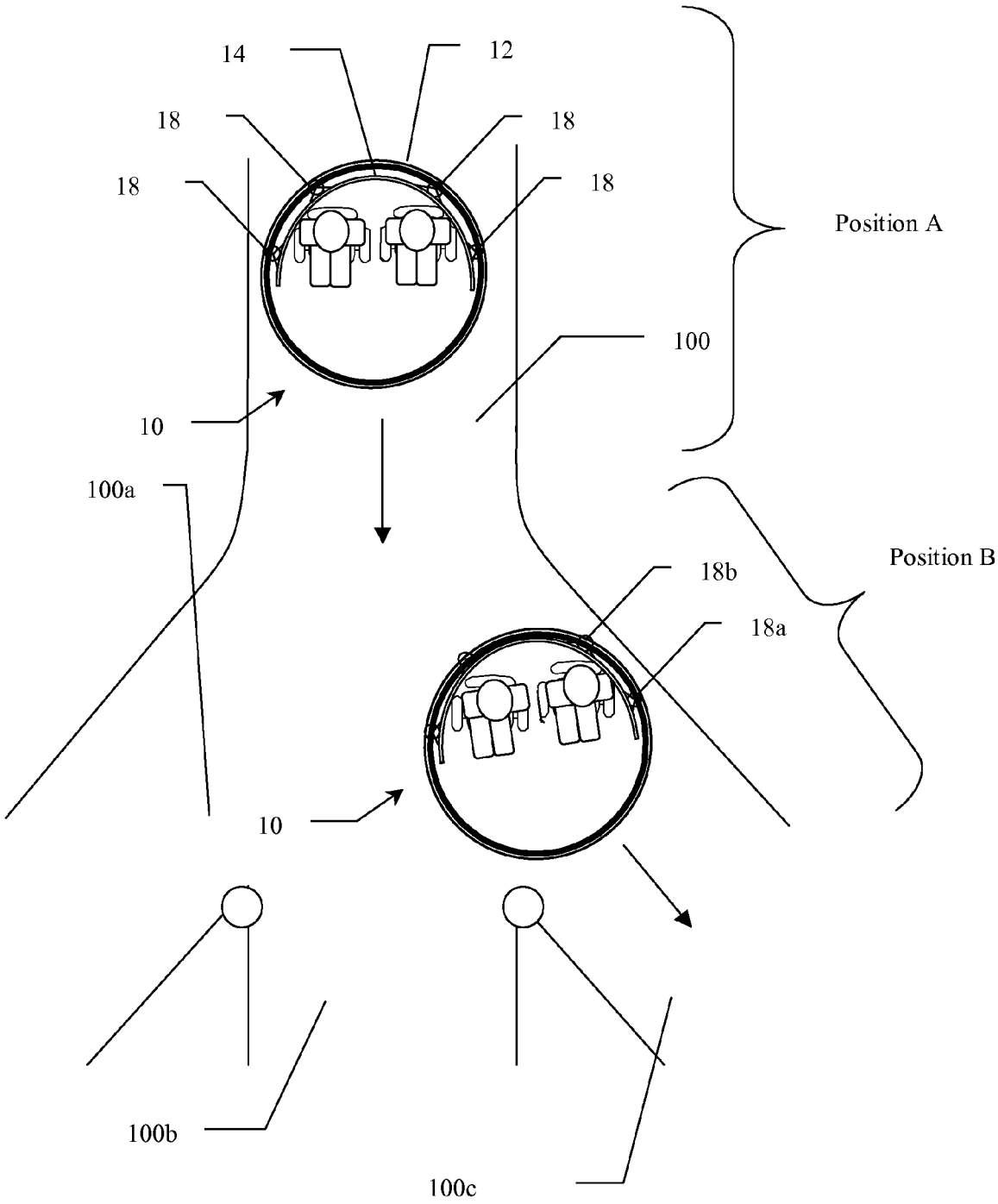
FIG. 4 is a partially cross-sectional, top-down view of one embodiment of the invention showing an illustrative course and path of travel for the riders within the sphere.

In yet another embodiment, riders can remain stationary in their seats and steer by causing certain rollers 18 (or combinations there of) to brake thereby causing inner carriage 14 to pivot on that point(s) and alter the center of mass of the vehicle 10. FIG. 4 provides an example. In position A of FIG. 4, vehicle 10 is moving down track 100 in a substantially straight line with rollers 18 in a neutral state, that is all rollers are unconstrained and are freely moving in support of the carriage motion relative the rotating outer sphere. Riders are faced with the option of continuing along path 100*a*, 100*b* or 100*c*. In position B of FIG. 4, riders elect to travel path 100*c* and apply resistance to rollers 18*a* and 18*b*, the resistance need not be equal and can be calculated by on-board logic circuits or can be actuated by manual control of the braking of one or several wheels. The uneven rotation of rollers 18 causes carriage 14 to rotate counter-clockwise and alters the center of mass of vehicle 10. Consequently, vehicle 10 veers to the left as it moves down path 100*c*.

Illustrative Embodiments

Vehicle 10 provides significant advantages over the prior art in that not only is the user in control of the inner rotation of the vehicle; the spherical vehicle can be used on either a "free form surface" or on a prescribed track. While prescribed tracks are the norm for amusement ride, a free form surface provides an open area over which each vehicle can travel. For example, the spherical vehicle of the invention could be conveyed to the top of a large "mountain" like structure covering a large area. The sphere would then roll freely down the surface that would have a variety of features including troughs, valleys, maelstroms, "worm-holes," etc. The nature of the navigable features is selected in accordance with the theme of the attraction. Riders could "steer" to these features. The spheres could enter tunnels which would have orchestrated light and sound to enhance the experience. Features could be connected via conveyors. Riders could "interact" with the environment of the amusement ride by steering to specific experiences.

Figure 5A:
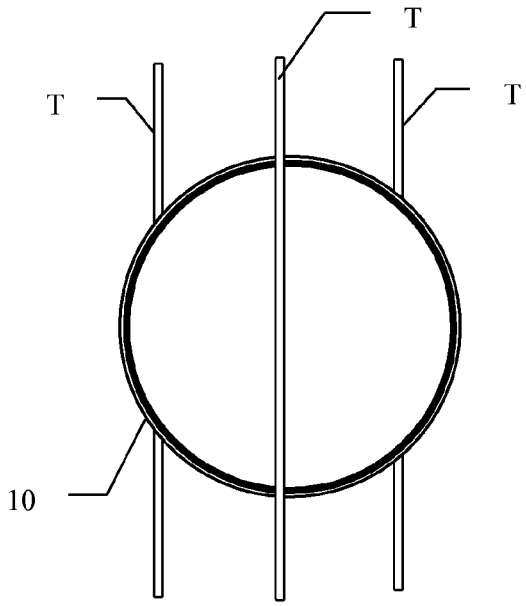
FIG. 5A is an elevated view of the inventive vehicle using a three track guidance system.
Figure 5B:
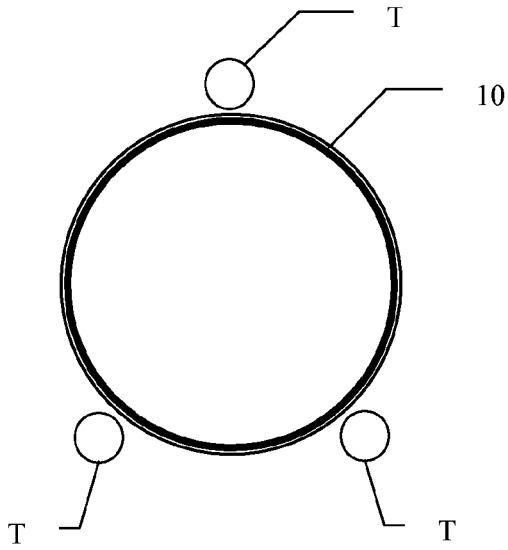
FIG. 5B is a front-perspective view of the inventive vehicle using a three track guidance system.
Figure 5C:
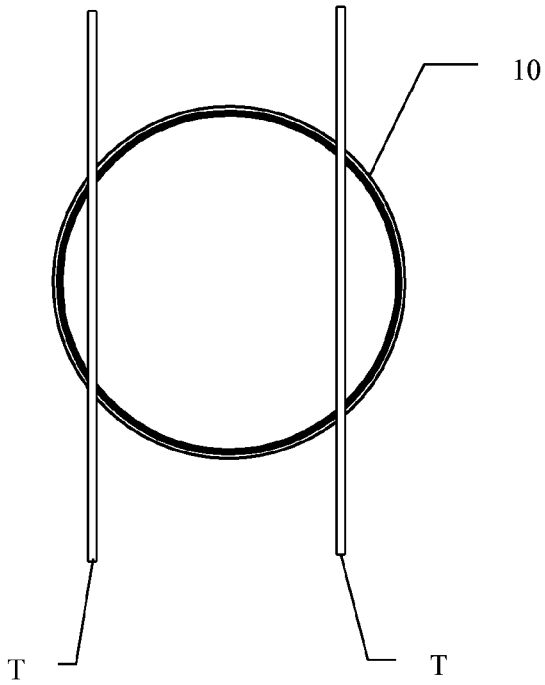
FIG. 5C is an elevated view of the inventive vehicle using a four track guidance system.
Figure 5D:
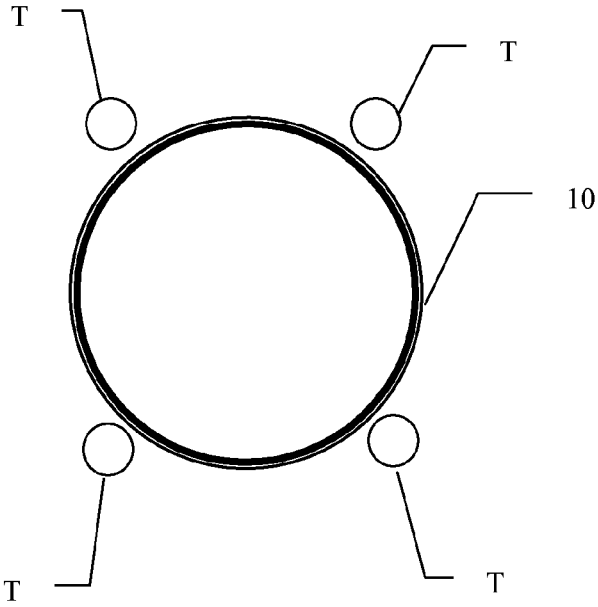
FIG. 5D is a front-perspective view of the inventive vehicle using a three track guidance system.

FIGS. 5A through 5D illustrate examples of fixed tracks for use with the invention. Fixed track structures are the traditional embodiment of roller coasters. FIGS. 5A and 5B represent the use of the invention on a 3 track (T) configuration. Similarly, FIGS. 5C A*nd* 5D represent the use of the invention on a 4 track (T) configuration.

In use, vehicles of the current invention can be transported to their starting points using a variety of methods. In addition to a conventional elevator, a modified "Archimedes Screw" can be used to transport vehicles. The machine consists of a large screw inside a hollow pipe having a sufficient diameter to accommodate the spherical vehicle. Here, a screw is any inclined plane wrapped around a rotatable axle or cylinder. The lower end of the device is positioned near the loading point for the vehicles. As the screw is turned, it scoops up, or captures, the spherical vehicles. The vehicles then "slide up" in the spiral tube as the axle is turned, until it finally exits out from the top of the tube and begins to roll under the power of gravity.

Alternatively, a pneumatic system can be employed. Various devices for lifting a spherical body containing a human rider are know. U.S. Pat. Nos. 4,487,410 and 4,545,574 to Sassak describe methods of lifting a spherical body having a passenger with fluid power and are incorporated herein by reference.

Simulators

Figure 6:
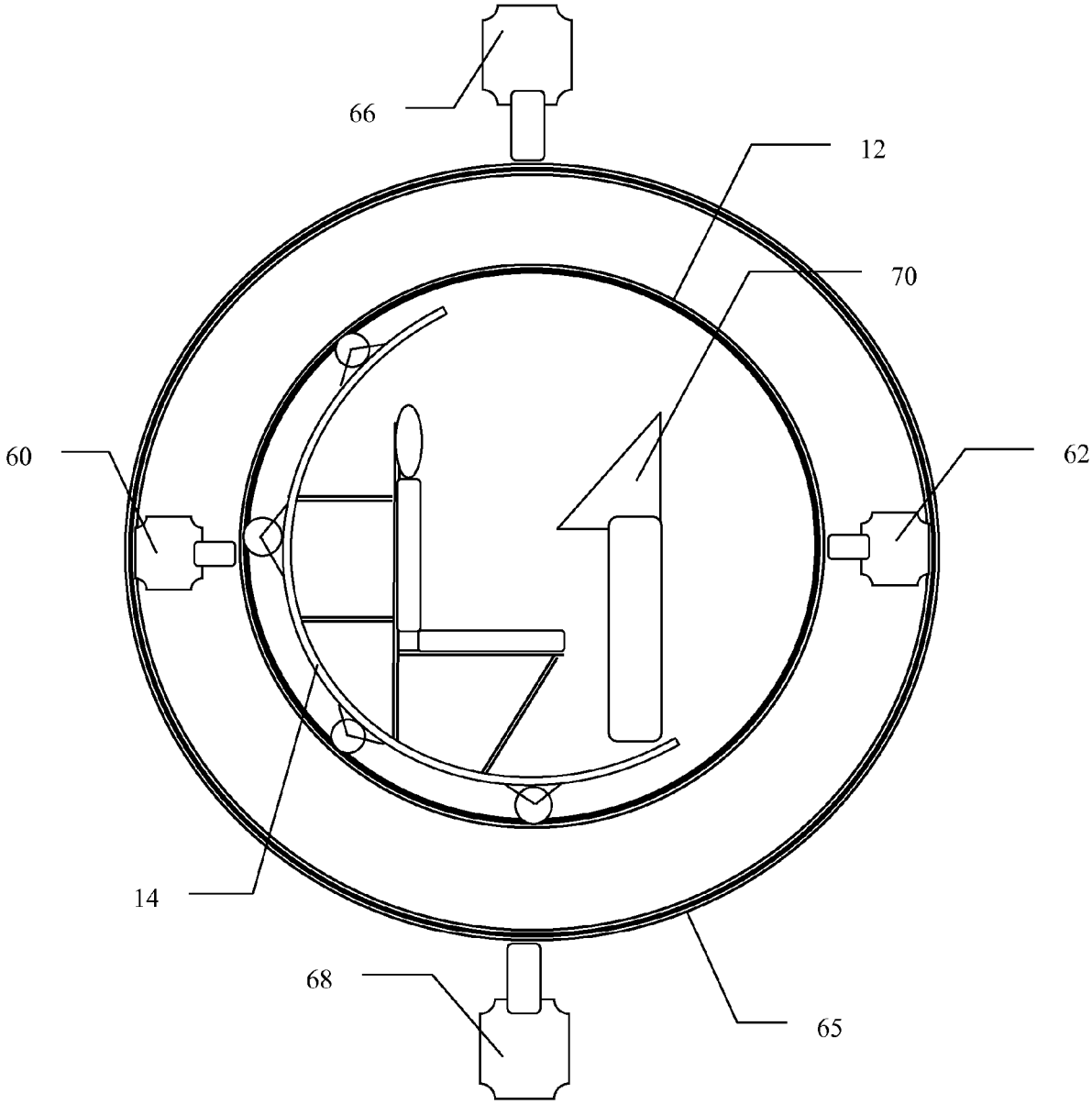
FIG. 6 is a partially sectional, elevated view of the inventive vehicle in use as a ride simulation.

Another embodiment, shown in FIG. 6, includes a ride simulator wherein the vehicle has increased rotational movement but does not actually move in any line. In this embodiment, inner carriage 14 is contained within sphere 12. As in previous embodiments carriage 14 is free to roll within sphere 12. Sphere 12 is connected to two power servomotors 60 and 62.

Servomotors 60 and 62 are connected to the inner surface of outer sphere 65. Outer sphere 65 is connected to similar servomotors 66 and 68. The servomotors (60, 62, 66 and 68) are controlled by software that contains a "virtual environment" for the simulated experience.

Viewing Screen 70 is positioned to project a virtual scene to the rider responsive to his/her steering within the vehicle. The images on the viewing screen are transmitted via wireless signals from an external system. This external system contains the virtual 3-D environment, as well as necessary circuitry for transmitting signals from the steering circuits to the servo motors that control the motion of the sphere 12 and sphere 65.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between. Now that the invention has been described,

What is claimed is:

1. A vehicle, comprising:

a spherical outer shell having a first diameter;

an inner shell having a second diameter less than said first diameter;

a plurality of spherical rollers having a diameter substantially equal to one-half the difference between said first diameter and said second diameter;

said inner shell being positioned within a hollow interior of said spherical outer shell and sharing a common center therewith so that said inner shell is concentrically disposed relative to said spherical outer shell;

said plurality of spherical rollers being disposed in spaced apart relation to one another in a space that separates the spherical outer shell from the inner shell so that said outer and inner shells may rotate about said common center independently of one another;

at least one passenger seat disposed within said inner shell, said at least one passenger seat adapted to support a passenger;

said at least one passenger seat adapted for lateral movement within said inner shell;

said vehicle being steered by a passenger seated upon said at least one passenger seat, said passenger steering said vehicle by manually displacing said at least one passenger seat in a preselected lateral position.

2. The vehicle of claim 1, further comprising:

said inner shell having a spherical configuration.

3. The vehicle of claim 1, further comprising:

said inner shell having a hemispherical configuration.

4. A vehicle, comprising:

a spherical outer shell having a first diameter;

an inner shell having a second diameter less than said first diameter;

a plurality of spherical rollers having a diameter substantially equal to one-half the difference between said first diameter and said second diameter;

said inner shell being positioned within a hollow interior of said spherical outer shell and sharing a common center therewith so that said inner shell is concentrically disposed relative to said spherical outer shell;

said plurality of spherical rollers being disposed in spaced apart relation to one another in a space that separates the spherical outer shell from the inner shell so that said outer and inner shells may rotate about said common center independently of one another;

at least one passenger seat disposed within said inner shell, said at least one passenger seat adapted to support a passenger;

a hollow casing fixedly secured to said spherical inner shell;

a weight slideably mounted within said hollow casing;

a handle adapted to be engaged by a passenger seated in said at least one passenger seat;

said handle engaged to said weight so that movement of said handle effects movement of said weight;

whereby when said spherical outer shell is rolling on a surface, a passenger seated in said at least one passenger seat may control the direction of said rolling by manipulating said handle.

5. The vehicle of claim 4, further comprising:

said handle being pivotally secured to said casing at a first pivot point that is between a proximal and a distal end of said handle;

said handle being pivotally secured to said weight at a second pivot point at a distal end of said handle;

whereby said passenger manipulates a proximal end of said handle and causes said handle to pivot about said first pivot point, thereby causing sliding displacement of said weight in said hollow casing.

6. The vehicle of claim 4, further comprising:

said inner shell having a spherical configuration.

7. The vehicle of claim 4, further comprising:

said inner shell having a hemispherical configuration.

8. A vehicle, comprising:

a spherical outer shell having a first diameter;

an inner shell having a second diameter less than said first diameter;

a plurality of spherical rollers having a diameter substantially equal to one-half the difference between said first diameter and said second diameter;

said inner shell being positioned within a hollow interior of said spherical outer shell and sharing a common center therewith so that said inner shell is concentrically disposed relative to said spherical outer shell;

said plurality of spherical rollers being disposed in spaced apart relation to one another in a space that separates the spherical outer shell from the inner shell so that said outer and inner shells may rotate about said common center independently of one another;

at least one passenger seat disposed within said inner shell;

said vehicle adapted to follow a path of travel defined by a plurality of downwardly inclined guide rails that capture said spherical outer shell and allow it to roll along a path of travel defined by said guide rails; and said plurality of guide rails arrayed in a triangular configuration to capture said spherical outer shell.

9. The vehicle of claim 8, further comprising:

said inner shell having a spherical construction.

10. The vehicle of claim 8, further comprising:

said inner shell having a hemispherical construction.

11. A vehicle, comprising:

a spherical outer shell having a first diameter;

an inner shell having a second diameter less than said first diameter;

a plurality of spherical rollers having a diameter substantially equal to one-half the difference between said first diameter and said second diameter;

said inner shell being positioned within a hollow interior of said spherical outer shell and sharing a common center therewith so that said inner shell is concentrically disposed relative to said spherical outer shell;

said plurality of spherical rollers being disposed in spaced apart relation to one another in a space that separates the spherical outer shell from the inner shell so that said outer and inner shells may rotate about said common center independently of one another;

at least one passenger seat disposed within said inner shell;

said vehicle adapted to follow a path of travel defined by a plurality of downwardly inclined guide rails that capture said spherical outer shell and allow it to roll along a path of travel defined by said guide rails; and said plurality of guide rails arrayed in a square configuration to capture said spherical outer shell.

12. The vehicle of claim 11, further comprising:

said inner shell having a spherical construction.

13. The vehicle of claim 11, further comprising:

said inner shell having a hemispherical construction.

* * * * *